US006116053A

United States Patent [19]

Siebenberg

[11] Patent Number: 6,116,053

[45] Date of Patent: Sep. 12, 2000

[54] SEAMLESS HOLLOW WEDDING BAND WITH COMFORT FIT

[75] Inventor: Benjamin Siebenberg, White Plains, N.Y.

[73] Assignee: Am-Gold Corp., New York, N.Y.

[21] Appl. No.: 09/212,653

[22] Filed: Dec. 16, 1998

[51] Int. Cl.[7] ..... A44C 19/00

[52] U.S. Cl. ..... 63/15; 63/3

[58] Field of Search ..... 63/3, 15; 29/896.411, 29/896.412

[56] References Cited

U.S. PATENT DOCUMENTS

| | | | |
|---|---|---|---|
| Re. 4,253 | 2/1871 | Codding, Jr. | 63/3 |
| D. 33,674 | 12/1900 | Bliss, Jr. | 63/15 X |
| 82,546 | 9/1868 | Peckham | 63/15 |
| 91,604 | 6/1869 | Codding, Jr. | 63/3 |
| 114,856 | 5/1871 | Richmond et al. | 63/15 |
| 150,741 | 5/1874 | Barrows | 63/3 |
| 169,929 | 11/1875 | Thomson | 63/3 |
| 228,348 | 6/1880 | Hayward | 63/3 |
| 404,956 | 6/1889 | Burdon | 63/15 |
| 625,959 | 5/1899 | Saart | 63/3 |
| 685,653 | 10/1901 | Stafford | 63/15 |
| 1,051,903 | 2/1913 | Mason | 63/3 |
| 1,308,894 | 7/1919 | Dinhofer | 63/15 |
| 1,916,821 | 7/1933 | Bigney | 63/3 X |
| 3,877,249 | 4/1975 | Sager | 63/15 |
| 4,989,420 | 2/1991 | Reinhold et al. | 63/15 |
| 5,916,271 | 6/1999 | Baum | 63/15 |

*Primary Examiner*—Terry Lee Melius
*Assistant Examiner*—Andrea Chop
*Attorney, Agent, or Firm*—Levisohn, Lerner, Berger & Langsam

[57] ABSTRACT

A method of manufacturing a seamless hollow comfort fit wedding band is provided, where precious metal is flattened into a metal sheet from which ring-size "washers" are punched out at a press-machine. The seamless comfort fit look is then achieved by forming thin concave and convex shaped rings out of the "washers", which are later slipped into each other and soldered at their side edges to form one comfort fit wedding band.

3 Claims, 4 Drawing Sheets

SEAMLESS HOLLOW WEDDING BAND WITH COMFORT FIT

FIELD OF THE INVENTION

The present invention relates to jewelry items. More specifically, the present invention relates to a wedding band designed as a hollow seamless ring which is curved on the inside for a comfort fit.

BACKGROUND OF THE INVENTION

Wedding bands are the most common, widely worn form of rings. Generally, they are made as endless seamless solid, and, therefore, are heavy rings of precious metal. As a result, wedding bands are expensive. Rings can have different cross-sectional shapes to fit a finger differently. Regular fit wedding bands, as shown in FIG. 1, for example, are flat on the inside. To allow a ring to be put on and taken off easily, the inside of a solid wedding band can be curved, as shown in FIG. 2. Such a design, known in the industry as "comfort fit," may demand an even higher amount of precious metal to be used for each ring. More elaborate wedding bands have also been made to contain precious or semiprecious gems, engravings and so forth.

In order to make wedding bands more affordable, it is desirable to reduce the amount of precious metal used to manufacture a single band. For this reason a thin wedding band was created, as shown in FIG. 3. In such modified design, a thin narrow strip of precious metal is gradually bent until this strip acquires a shape of a spiral with a plurality of loops. Each of these loops is then separated from the spiral, and its edges are seamed together. As a result of this process, thin rings have a very unattractive seam in the middle of the ring which is visible on both the inside and outside of the band. In addition, this design presents a "cheaper" look which is not desirable for consumers who generally prefer to get the "expensive" look of solid bands at a lower price. Moreover, such thin ring cannot be made "comfort fit", in its industry meaning. It can only be made easier to wear by rounding side edges of the ring.

Accordingly, there is a long standing interest in the art for a wedding band design allowing a consumer to have a seamless comfort fit look identical to a solid band, while providing a greater affordability because of a lower weight. There is also a need in the art for a process, which can be implemented to manufacture seamless hollow wedding bands, particularly with comfort fit.

SUMMARY OF THE INVENTION

It is an object of the present invention to provide a lightweight, inexpensive wedding band.

It is another object of the present invention to provide a hollow wedding band, which can be made seamless.

It is a further object of the present invention to provide a seamless hollow wedding band with comfort fit.

It is a further object of the present invention to provide a method for creating a seamless hollow wedding band with comfort fit.

Other objects, advantages and features of this invention will become more apparent hereinafter.

The objects of the present invention are accomplished by providing a process for manufacturing a seamless hollow wedding band with a comfort fit. The seamless comfort fit look is achieved in this process by forming thin concave and convex shaped rings, which are later slipped into each other and soldered at their side edges to form one comfort fit wedding band.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE PREFERRED EMBODIMENT AND THE DRAWINGS

Figure 1:
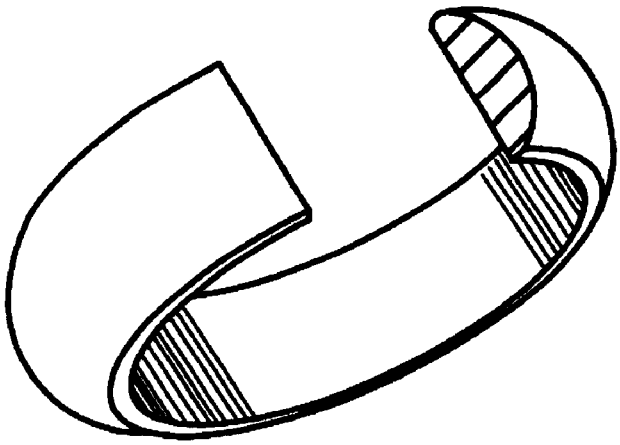
(PRIOR ART) FIG. 1
FIG. 1 is an enlarged perspective view of a prior art solid wedding band with a regular fit, with a portion of the ring shown broken for clarity.
Figure 2:
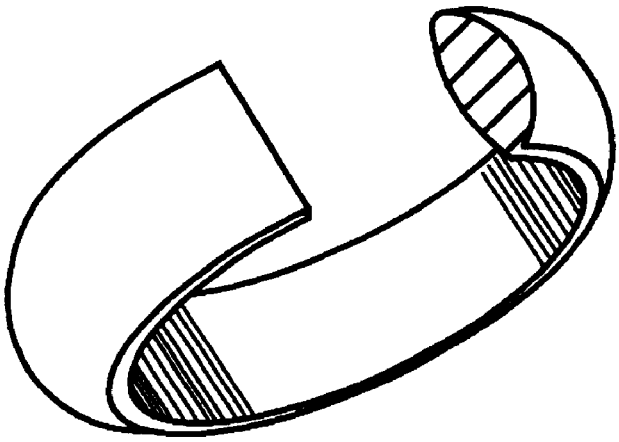
(PRIOR ART) FIG. 2
FIG. 2 is an enlarged perspective view of a prior art solid wedding band with a comfort fit, with a portion of the ring shown broken for clarity.
Figure 3:
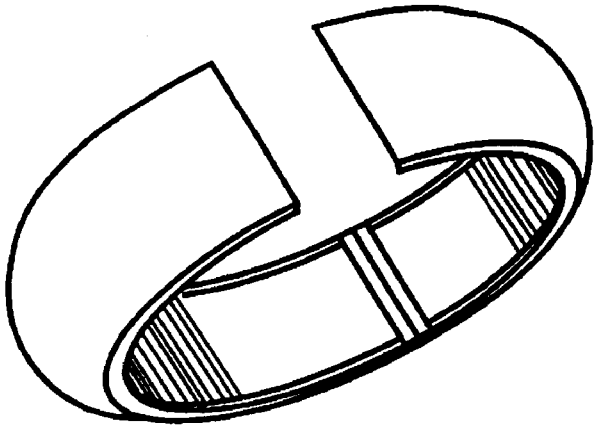
(PRIOR ART) FIG. 3
FIG. 3 is an enlarged perspective view of a prior art thin wedding band with a seam, with a portion of the ring shown broken for clarity.
Figure 4:
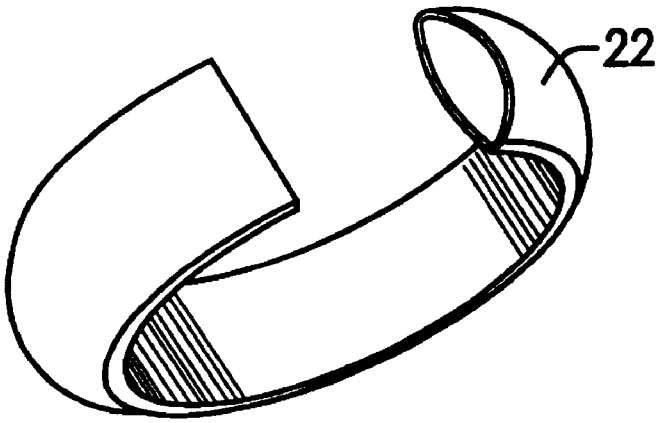
(PRIOR ART) FIG. 4
FIG. 4 is an enlarged perspective view of a seamless hollow wedding band with a comfort fit, in accordance with the present invention, with a portion of the ring shown broken for clarity.

There are two conventional methods that are typically used to manufacture solid wedding bands, as the ones shown in FIGS. 1 and 2, for example. During the first process, precious metal in the form of a tube is sliced into a desired number of "washers," which are then configured under pressure into rings of a predetermined shape. Different ring sizes require tubes of different diameters.

In the second process, the precious metal is flattened into a metal sheet from which ring-size "washers" are punched out at a press-machine. The thickness of the metal sheet depends upon a desired width of a future band. As in the process described above, the "washers" are then shaped under pressure into rings of a desired fit. Any one of the two described methods can be used with the presently invented process, however the second method is preferred.

Figure 5:
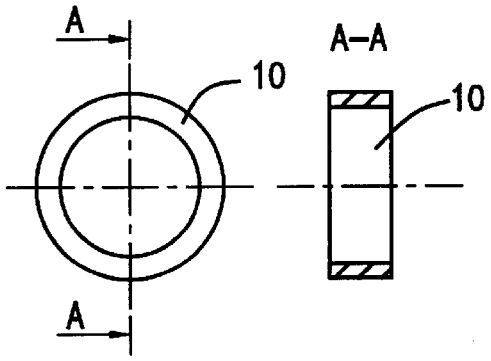
FIG. 5 is an enlarged side view of a "washer" with its cross section taken along the line A—A.
Figure 6:
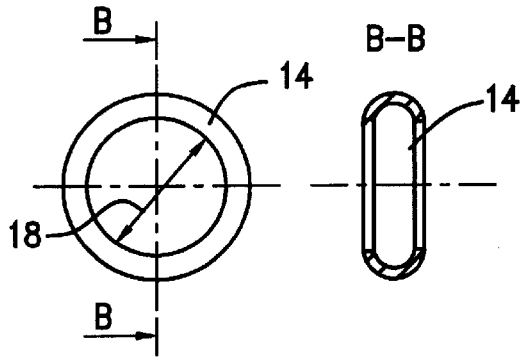
FIG. 6 is an enlarged side view of a convex ring with its cross section taken along the line B—B.
Figure 7:
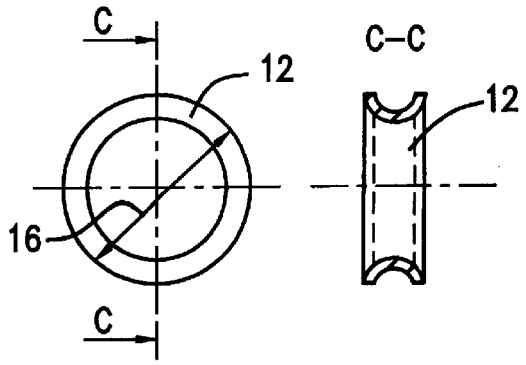
FIG. 7 is an enlarged side view of a concave ring with its cross section taken along the line C—C.
Figure 8:
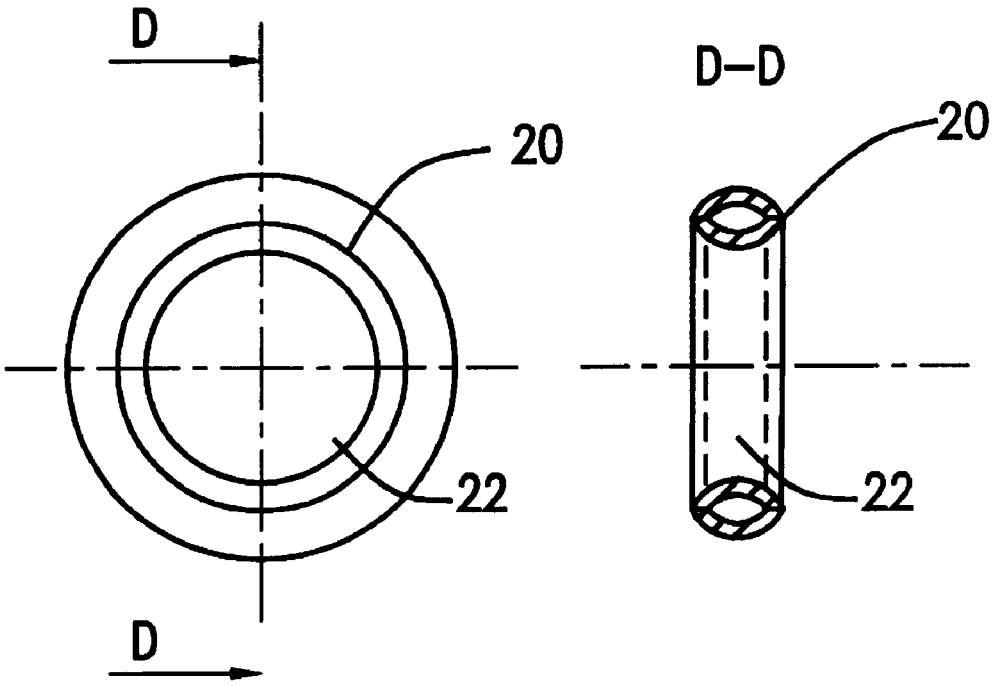
FIG. 8 is an enlarged side view of a seamless hollow comfort fit wedding band in accordance with the present invention together with its cross section taken along the line D—D.

In accordance with the present invention, the "washers" 10 punched out of the metal sheet must have very thin walls, preferably 0.5 mm in thickness. The enlarged cross-sectional view of such "washer" 10 is shown in FIG. 5. Pressure is then applied to these "washers" to form thin-walled concave and convex-shaped rings, respectively 12 and 14, shown in FIGS. 6 and 7. These rings are preferably shaped in such a way that an outside diameter 16 of a concave ring 12 is equal to an inside diameter 18 of a convex ring 14 for the same ring size. Concave rings 12 are then slipped into convex rings 14 and soldered together at their side edges 20 to form a comfort fit wedding band 22, as shown in FIG. 8.

Although the invented process was described above with respect to a comfort fit wedding band, it is not limited to manufacture of comfort fit rings only. To create a regular fit seamless hollow wedding band, for example, a manufacturer can use the same process. However, instead of forming corresponding pairs of concave and convex-shaped rings, a manufacturer will form pairs of convex-shaped and regular, flat rings, which are then soldered together at their side edges. In this design, a diameter of the flat ring should be equal to an inside diameter of the convex ring.

An average size gold wedding band made by this novel method weights about two grams each, which is relatively lightweight compared with a prior art solid gold wedding band, which typically weights more than eight grams. Consequently, the new seamless hollow wedding band is less expensive.

In accordance with the present invention, a seamless hollow wedding band can be made of any desired width. Typically, the width of a wedding band falls within the range of 2–10 mm.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

I claim as follows:

1. A hollow wedding band, comprising:

a first outer ring having a first outer diameter and a first inner diameter and a first width, said first outer ring being a closed loop having an open substantially C-shaped convex cross-section, said first outer ring having a primary outer surface; and a second inner ring having a second width substantially equal to said first width and a second outer diameter substantially equal to but slightly smaller than said first inner diameter, said second inner ring being a closed loop, said second inner ring being fit inside and fixed to said first outer ring, said first and second rings each having two circumferential edges, wherein said primary outer surface has no seams after said second inner ring is fixed to said first outer ring, and wherein said second inner ring is fixed to said first outer ring by soldering along said circumferential edges.

2. A hollow wedding band according to claim 1, wherein a cross-section of said second inner ring is one of convex and flat.

3. A hollow wedding band according to claim 1, wherein said inner ring has an open C-shaped convex cross-section and said respective cross-sections of said outer and inner rings each has an open side and a closed side, wherein said two respective open sides are faced together.

* * * * *